US007174114B2

(12) United States Patent
Gila et al.

(10) Patent No.: US 7,174,114 B2
(45) Date of Patent: Feb. 6, 2007

(54) APPARATUS AND METHOD FOR REDUCING CONTAMINATION OF AN IMAGE TRANSFER DEVICE

(75) Inventors: Omer Gila, Cupertino, CA (US); Michael H. Lee, San Jose, CA (US); Seongsik Chang, San Jose, CA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 59 days.

(21) Appl. No.: 10/902,723

(22) Filed: Jul. 29, 2004

(65) Prior Publication Data

US 2006/0024082 A1 Feb. 2, 2006

(51) Int. Cl.
*G03G 15/02* (2006.01)
*G03G 21/00* (2006.01)
*G03G 21/20* (2006.01)

(52) U.S. Cl. ..... 399/100; 399/92; 399/93; 399/98; 399/99; 399/170; 399/171

(58) Field of Classification Search ..... 399/92, 399/93, 98, 99, 100, 170, 171
See application file for complete search history.

(56) References Cited

U.S. PATENT DOCUMENTS

| | | | | |
|---|---|---|---|---|
| 4,720,727 | A * | 1/1988 | Yoshida | 399/93 |
| 4,725,731 | A | 2/1988 | Lang | |
| 4,954,843 | A * | 9/1990 | Oka et al. | 399/156 |
| 5,170,211 | A | 12/1992 | Haupt et al. | |
| 5,485,251 | A | 1/1996 | Kita et al. | |
| 6,339,688 | B1 * | 1/2002 | Cho et al. | 399/93 |
| 6,385,414 | B1 | 5/2002 | Sato et al. | |
| 6,678,486 | B2 * | 1/2004 | Amering et al. | 399/92 |
| 6,708,009 | B2 | 3/2004 | Fuwazaki et al. | |
| 2003/0128996 | A1 | 7/2003 | Fournia | |

FOREIGN PATENT DOCUMENTS

JP 61190353 A * 8/1986

* cited by examiner

*Primary Examiner*—David M. Gray
*Assistant Examiner*—Joseph S. Wong

(57) ABSTRACT

An apparatus and method for reducing contamination of an image transfer surface in an image transfer device includes a charging device for charging the image transfer surface. An airflow control system ventilates the charging device and restricts airflow adjacent the image transfer surface.

30 Claims, 7 Drawing Sheets

APPARATUS AND METHOD FOR REDUCING CONTAMINATION OF AN IMAGE TRANSFER DEVICE

BACKGROUND OF THE INVENTION

The present invention generally relates to image transfer technology and, more particularly, to an apparatus and method for reducing contamination of image transfer surfaces of image transfer devices during the printing process, and an image transfer device having the apparatus.

As used herein, the term "image transfer device" generally refers to all types of devices used for creating and/or transferring an image in a liquid electrophotographic process, including laser printers, copiers, facsimiles, and the like.

In a liquid electrophotographic (LEP) printer, the surface of a photoconducting material (i.e., a photoreceptor) is charged to a substantially uniform potential so as to sensitize the surface. An electrostatic latent image is created on the surface of the photoconducting material by selectively exposing areas of the photoconductor surface to a light image of the original document being reproduced. A difference in electrostatic charge density is created between the areas on the photoconductor surface exposed and unexposed to light. In LEP, the photoconductor surface is initially charged to approximately ±1000 Volts, with the exposed photoconductor surface discharged to approximately ±50 Volts.

The electrostatic latent image on the photoconductor surface is developed into a visible image using developer liquid, which is a mixture of solid electrostatic toners or pigments dispersed in a carrier liquid serving as a solvent (referred to herein as "imaging oil"). The carrier liquid is usually insulative. The toners are selectively attracted to the photoconductor surface either exposed or unexposed to light, depending on the relative electrostatic charges of the photoconductor surface, development electrode, and toner. The photoconductor surface may be either positively or negatively charged, and the toner system similarly may contain negatively or positively charged particles. For LEP printers, the preferred embodiment is that the photoconductor surface and toner have the same polarity.

A sheet of paper or other medium is passed close to the photoconductor surface, which may be in the form of a rotating drum or a continuous belt, transferring the toner from the photoconductor surface onto the paper in the pattern of the image developed on the photoconductor surface. The transfer of the toner may be an electrostatic transfer, as when the sheet has an electric charge opposite that of the toner, or may be a heat transfer, as when a heated transfer roller is used, or a combination of electrostatic and heat transfer. In some printer embodiments, the toner may first be transferred from the photoconductor surface to an intermediate transfer medium, and then from the intermediate transfer medium to a sheet of paper.

Charging of the photoconductor surface may be accomplished by an ionization device. Several types of ionization devices are known, such as a corotron (a corona wire having a DC voltage and an electrostatic shield), a dicorotron (a glass covered corona wire with AC voltage, and electrostatic shield with DC voltage, and an insulating housing), a scorotron (a corotron with an added biased conducting grid), a discorotron (a dicorotron with an added biased conducting strip), a pin scorotron (a corona pin array housing a high voltage and a biased conducting grid), or a charge roller. Each of these ionization devices generate ozone ($O_3$), and nitric oxides ($NO_x$), which if present in sufficient quantities, must be vented and filtered from the image transfer device.

An active flow of air through the image transfer device may be provided to ventilate and filter ozone and/or nitric oxides from the image transfer device. Although an active airflow through the image transfer device is sometimes required or desired for ventilation, airflow through or past the photoconductor surface is problematic in long term use of the photoconductor surface. In particular, active airflow is problematic because the airflow evaporates the submicron oil layer on the photoconductor surface and entrains oil vapors present above the oil layer, thereby effectively thinning the oil layer. The remaining oil layer includes residual materials such as charge directors and other dissolved ink components that have high molecular weight and do not easily evaporate. The thinned oil layer provides reduced buffering of the molecules of residual material against ion bombardment, UV exposure and ozone penetration. Therefore, the residual materials in the oil are more likely to react and polymerize on the photoconductor surface. Additionally, the dissolved residual material in the thinned oil layer is much closer to or beyond its solubility limit. This increases the chance for dissolved residual materials to drop out of solution and polymerize on the photoconductor surface.

The contaminating film of polymerized material on the photoconductor surface eliminates the ability to either form latent images of small dots on the photoconductor surface, or transfer small dots from the photoconductor surface to paper. As contamination of the photoconductor increases over time, the print quality of subsequently printed images is reduced, and the useful life of the photoconductor surface is shortened. The contamination problem is often referred to as old photoconductor syndrome (OPS).

Representations of prior art embodiments of charging apparatuses using ionization-type charging devices and having ventilation systems are schematically illustrated in FIGS. 2A–2B. In the charging apparatus 30 of FIG. 2A, an active ventilating airflow in the direction of arrows 71 is established by a suitable vacuum system 72. Fresh air is drawn into the chamber 96 containing the charging device (i.e., corona wire 90 and grid 92) from outside the charging apparatus housing 80, and passes through a small gap 73 (created by positioning pins 86) between the housing 80 and the photoconductor surface 22, and then through conductive grid 92. The ozone generated near the corona wire 90 is drawn through an opening 74 at the end of chamber 96 opposite photoconductor surface 22, and then to a filter system 75. Due to the airflow between the housing 80 and the photoconductor surface 22, the submicron oil layer on the photoconductor surface 22 evaporates such that the oil layer is thinned, and some oil vapor becomes entrained in the airflow.

Problems caused by the illustrated airflow include contamination of the charging device (both corona wire 90 and grid 92), and contamination of the photoconductor surface 22. The charging device and interior housing walls become contaminated as the oil vapor entrained in the airflow reacts with the ozone, energetic ions and UV light to polymerize, and then coats the corona wire 90, conductive grid 92 and housing walls with sticky material. The efficiency of the coated corona wire 90 is immediately reduced. Further, the contamination forces frequent cleaning and/or replacement of the corona wire 90, conductive grid 92 and housing. The photoconductor surface 22 becomes contaminated as the residual material in the thinned oil layer reacts with the ozone, energetic ions and UV light to polymerize on the photoconductor surface 22, or drops out of solution and polymerizes on the photoconductor surface 22, as described above.

In the charging apparatus of FIG. 2B, an active ventilating airflow in the direction of arrows 76 is established by a suitable vacuum system 72. Fresh air is drawn into the chamber 96 containing the charging device (i.e., corona wire 90 and conductive grid 92) from a plenum 77 at the end of chamber 96 opposite photoconductor surface 22. The airflow moves through opening 74, past corona wire 90 and toward photoconductor surface 22. After the flow of air moves through the conductive grid 92 and small gap 73, the air is drawn out at one or more outlets 78 adjacent the photoconductor surface 22, and then to filter system 75. The ozone generated near the corona wire 90 is thereby forcibly moved through the conductive grid 92 and against the photoconductor surface 22.

As the airflow passes through the small gap 73 between the housing 80 and the photoconductor surface 22, the submicron oil layer on the photoconductor surface 22 evaporates such that the oil layer is thinned, and some oil vapor becomes entrained in the airflow. The photoconductor surface 22 becomes contaminated as the residual material in the thinned oil layer reacts with the ozone, energetic ions and UV light to polymerize on the photoconductor surface 22, or drops out of solution and polymerizes on the photoconductor surface 22, as described above. The rate of residual material polymerization on the photoconductor surface 22 is further increased as ozone is actively pulled toward the photoconductor surface 22 by the airflow path, thereby increasing the chemical exposure of the oil layer on the photoconductor surface 22.

During the process of charging the photoconductor surface, it is desirable that the photoconductor surface is free of residual materials from previous printing cycles, such as toner, charge directors and other dissolved materials in the imaging oil. However, effectively cleaning the photoconductor surface of all residual materials is very difficult, and some amount of residual material inevitably remains on the photoconductor surface. Therefore, there is a need for an apparatus or method to lessen or eliminate polymerization of the residual materials and the resulting filming of the photoconductor surface.

SUMMARY OF THE INVENTION

The invention described herein provides an apparatus and method for reducing contamination of an image transfer surface in an image transfer device. In one embodiment, the apparatus includes at least one charging device for charging the image transfer surface. An airflow control system is configured to ventilate the charging device and direct airflow in a direction substantially parallel to and spaced apart from the image transfer surface.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
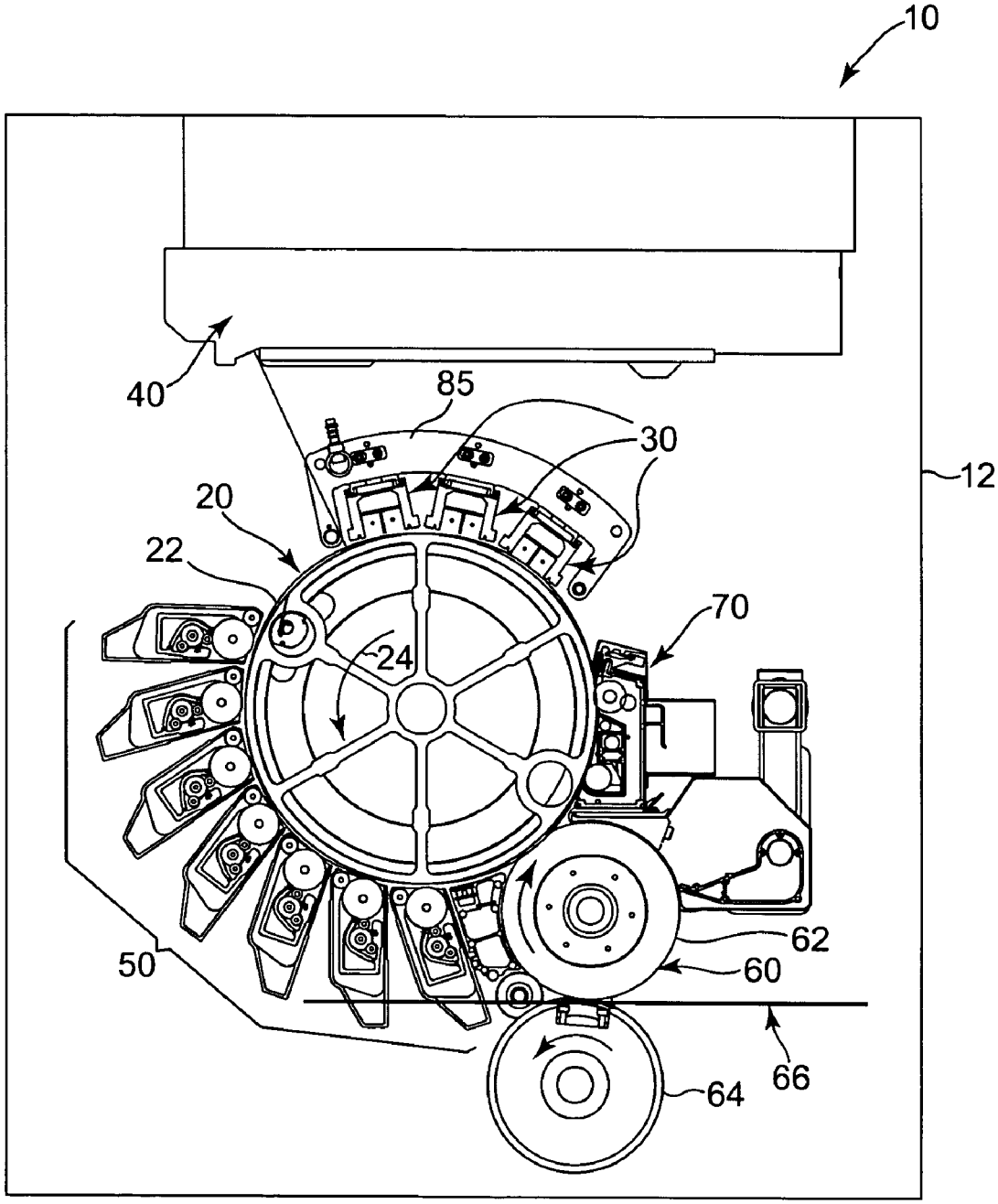
FIG. 1 is a schematic view of an exemplary image transfer device, showing a liquid electrophotographic printer for use with a charging apparatus having an airflow control system according to one embodiment of the invention.

An exemplary image transfer device having an image transfer surface, specifically an LEP printer 10 having a photoconductor surface 22, is schematically shown in FIG. 1. Although, for purpose of clarity, embodiments according to the invention are illustrated herein with respect to an LEP printer having a photoconductor surface, the invention is understood to be applicable and useful with other embodiments of image transfer surfaces and image transfer devices. As illustrated, the LEP printer 10 includes a printer housing 12 having installed therein a photoconductor drum 20 having the photoconductor surface 22. Photoconductor drum 20 is rotatably mounted within printer housing 12 and rotates in the direction of arrow 24. Several additional printer components surround the photoconductor drum 20, including a charging apparatus 30, an exposure device 40, a development device 50, an image transfer apparatus 60, and a cleaning apparatus 70.

Figure 3:
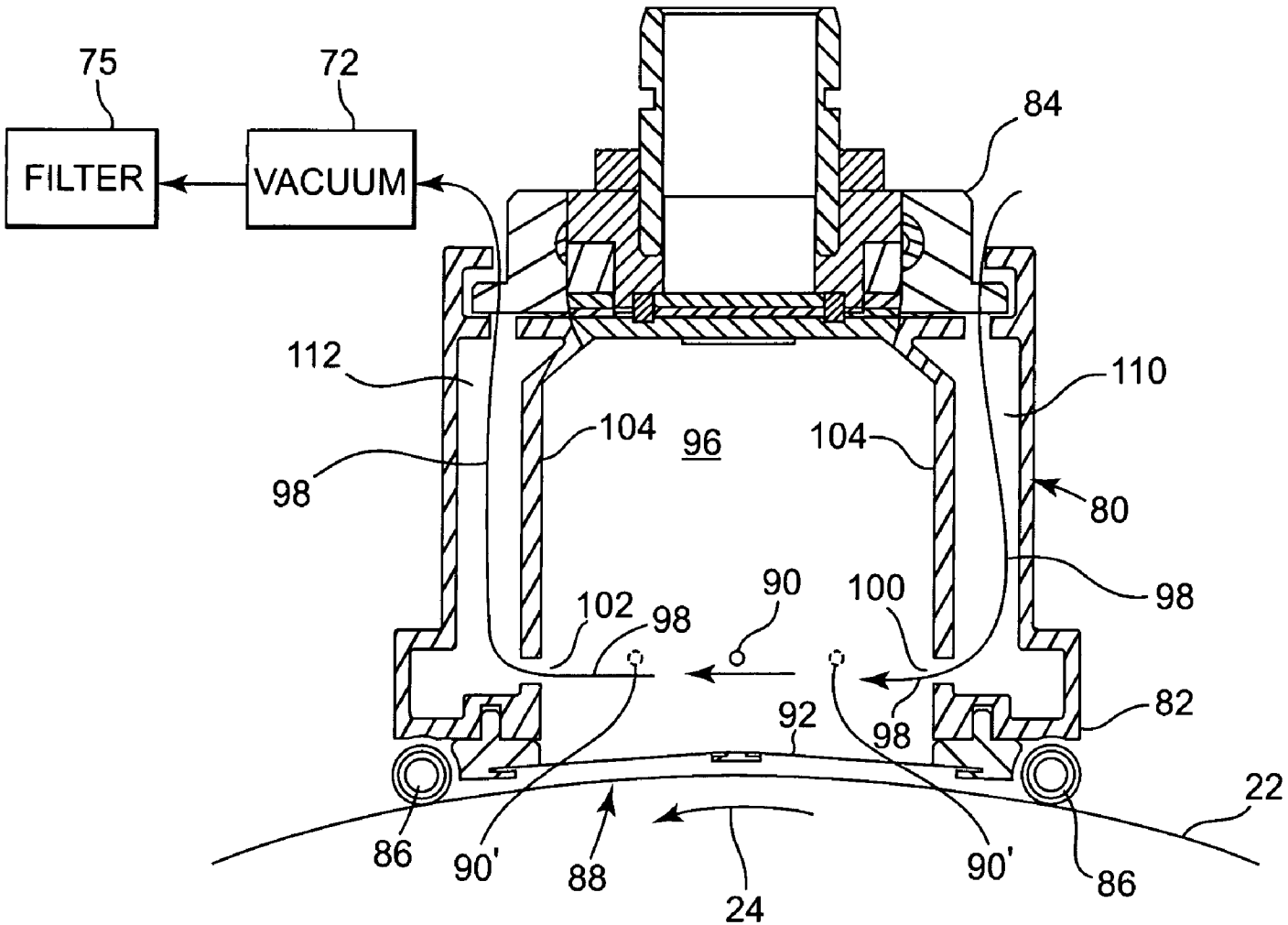
FIG. 3 is a schematic cross-sectional view of one embodiment of a charging apparatus having a single charging device and an airflow control system according to the invention.
Figure 4A:
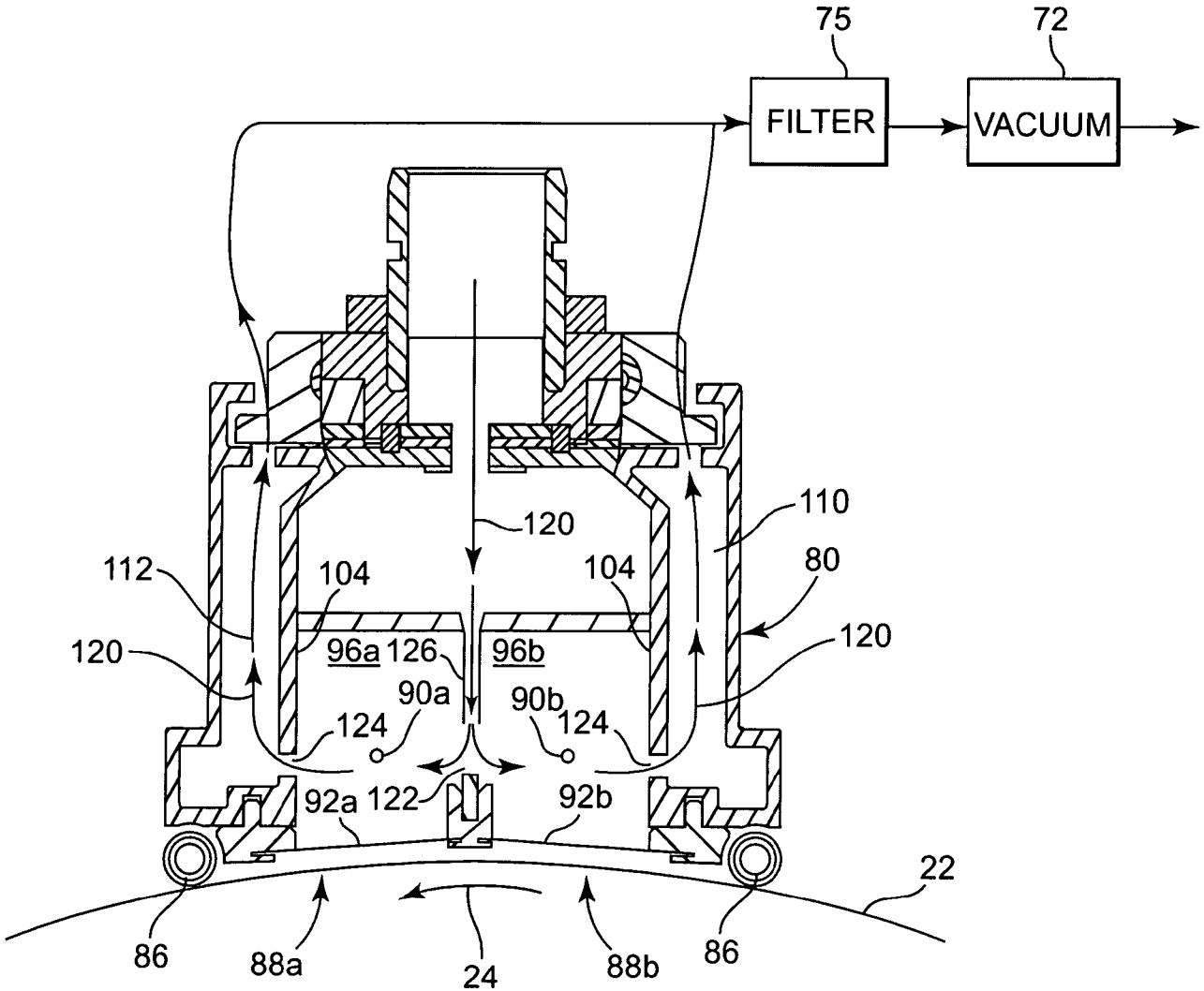
FIG. 4A is a schematic cross-sectional view of one embodiment of a charging apparatus having more than one charging device and an airflow control system according to the invention.

The charging apparatus 30 charges the photoconductor surface 22 on the drum 20 to a predetermined electric potential (typically ±500 to 1000 V). In some embodiments, as shown in FIG. 1, more than one charging apparatus 30 is provided adjacent the photoconductor surface 22 for incrementally increasing the electric potential of the surface 22. In other embodiments, only a single charging apparatus 30 is provided. In addition, referring to FIGS. 3 and 4, each charging apparatus 30 may contain a single charging device 88 for charging the photoconductor surface 22 to the desired electric potential in a single step (FIG. 3), or multiple charging devices 88 for charging the photoconductor surface 22 to the desired electric potential in a series of incremental steps (FIG. 4A). The number of charging apparatus 30 and charging devices 88 will be affected by factors including the process speed of surface 22 and the desired electric potential of the surface 22.

In one embodiment, charging apparatus 30 utilizes an ionization-type charging device 88. Referring to FIG. 3, during operation of the charging device 88, an electric potential sufficient to ionize air molecules within the chamber 96 is provided to the corona wire 90. For example, in one embodiment a potential of approximately −6000 Volts is provided to the corona wire 90. Forming what is referred to as a corona current, the ionized air molecules are drawn to the fully or partially discharged photoconductor surface 22 through the associated conductive grid 92. The grid 92 is biased to the desired potential of the photoconductor surface 22, for example approximately −1000 Volts. When charging of photoconductor surface begins, the photoconductor surface 22 is at an electric potential lower than the desired potential, and the corona current flows past the grid 92 to the surface 22. When the photoconductor surface 22 reaches the same potential as the grid 92 (i.e., the desired potential), the corona current to the surface 22 ceases. The grid 92 thus acts to control the final charge of the photoconductor surface 22.

The exposure device 40 forms an electrostatic latent image on the photoconductor surface 22 by scanning a light beam (such as a laser) according to the image to be printed onto the photoconductor surface 22. The electrostatic latent image is due to a difference in the surface potential between the exposed and unexposed portion of the photoconductor surface 22. The exposure device 40 exposes images on photoconductor surface 22 corresponding to various colors, for example, yellow (Y), magenta (M), cyan (C) and black (K), respectively.

The development device 50 supplies development liquid, which is a mixture of solid toner and imaging oil (such as Isopar), to the photoconductor surface 22 to adhere the toner to the portion of the photoconductor surface 22 where the electrostatic latent image is formed, thereby forming a visible toner image on the photoconductor surface 22. The development device 50 may supply various colors of toner corresponding to the color images exposed by the exposure device 40.

The image transfer apparatus 60 includes an intermediate transfer drum 62 in contact with the photoconductor surface 22, and a fixation or impression drum 64 in contact with the transfer drum 62. As the transfer drum 62 is brought into contact with the photoconductor surface 22, the image is transferred from the photoconductor surface 22 to the transfer drum 62. A printing sheet 66 is fed between the transfer drum 62 and the impression drum 64 to transfer the image from the transfer drum 62 to the printing sheet 66. The impression drum 64 fuses the toner image to the printing sheet 66 by the application of heat and pressure.

The cleaning apparatus 70 cleans the photoconductor surface 22 of some of the residual material using a cleaning fluid before the photoconductor surface 22 is used for printing subsequent images. In one embodiment according to the invention, the cleaning fluid is imaging oil as used by the development device 50. As the photoconductor surface 22 moves past the cleaning apparatus 70, a submicron layer of oil having residual material therein remains on the photoconductor surface 22.

Although not shown in FIG. 1, the liquid electrophotographic printer 10 further includes a printing sheet feeding device for supplying printing sheets 66 to image transfer apparatus 60, and a printing sheet ejection device for ejecting printed sheets from the printer 10.

As described above, airflow against the photoconductor surface 22 causes the submicron oil layer on the photoconductor surface 22 to evaporate, such that the oil layer is thinned, and some oil vapor becomes entrained in the airflow. The photoconductor surface 22 then becomes contaminated as the residual material in the thinned oil layer reacts with the ozone, energetic ions and UV light to polymerize on the photoconductor surface 22, or drops out of solution and polymerizes on the photoconductor surface 22, as described above.

One embodiment of a charging apparatus 30 having an airflow control system according to the invention that reduces contamination of the photoconductor surface 22 is schematically illustrated in FIG. 3. Charging apparatus 30 includes a housing 80 having a first end 82 and a second end 84. First end 82 of housing 80 is configured for positioning adjacent photoconductor surface 22 without contacting surface 22. It is preferred to avoid contact with photoconductor surface 22, such as with wipers or seals, so as to avoid mechanical thinning of the submicron oil layer. Mechanical thinning of the oil layer results in problems similar to those encountered when the oil layer is thinned by evaporation. Specifically, the thinned oil layer provides reduced buffering of the molecules of residual material against ion bombardment, UV exposure and ozone penetration. Therefore, the residual materials in the thinned oil layer are more likely to react and polymerize on the photoconductor surface 22. In addition to mechanically thinning the oil layer, wipers or seals pressed against the photoconductor surface 22 also act to remove oil vapor normally present above the oil layer as the photoconductor surface 22 moves past the wiper or seal. The removal of the oil vapor decreases the partial vapor pressure of the oil immediately adjacent the oil layer, and thereby further increases the rate of evaporation of the oil layer. As best seen in FIGS. 1 and 3, the housing 80 of the charging apparatus 30 may be positioned adjacent the photoconductor surface 22 without touching the surface 22 by a bridge assembly 85 that is connected to the printer housing 12, and also by positioning pins 86 that hold housing 80 away from photoconductor surface 22.

Referring again to FIG. 3, at least one charging device 88 is positioned within chamber 96 of housing 80, adjacent first end 82 of housing 80, such that the at least one charging device 88 is arranged adjacent photoconductor surface 22. Photoconductor surface 22 moves in the direction generally indicated by arrow 24. The charging device 88 is characterized by corona producing wire 90 and associated electrically conductive screen or grid 92 disposed between the corona wire 90 and the photoconductor surface 22 to be charged. The corona producing wire 90 comprises an elongated wire extending across the photoconductor surface 22. In preferred embodiments, corona wire 90 is positioned in the range of 4 to 15 mm from photoconductor surface 22, while conductive grid 92 is positioned approximately 1 mm or less from the photoconductor surface 22. In some embodiments, excess lengths of the corona wire 90 may be provided on a bobbin or other suitable supply device (not shown), such that the corona wire 90 can be periodically refreshed. Additionally, as illustrated in FIG. 3 by alternate corona wires 90', more than one corona wire can optionally be provided in chamber 96. Although, for purposes of clarity, the charging device 88 of charging apparatus 30 is illustrated herein as a scorotron, the invention is understood to be applicable and useful with other types of charging devices, particularly ionization-type charging devices used in image transfer devices, such as corotrons, dicorotrons, and discorotrons.

In the charging apparatus of FIG. 3, the airflow control system establishes an active ventilating airflow that protects the oil layer on the photoconductor surface from evaporative thinning. As seen in FIG. 3, the airflow control system directs air through chamber 96 in the direction of arrows 98 by a suitable vacuum system 72 providing a volume airflow in the range of 0.1 to 30 liters/second, depending upon the ventilation requirements of the particular imaging application. An air inlet 100 and air outlet 102 are provided in opposite side walls 104 of the chamber 96, such that air flows through chamber 96 from the air inlet 100 to the air outlet 102 in a direction substantially parallel to and spaced apart from the photoconductor surface 22 and the conductive grid 92, and then on to a filter system 75, without being directed toward or against the photoconductor surface 22.

The air inlet 100 and air outlet 102 are preferably positioned in the sidewalls 104 of chamber 96 such that the airflow is directed over corona wire 90, and further such that airflow between the photoconductor surface 22 and the conductive grid 92 is restricted or eliminated. Air inlet 100 and air outlet 102 are positioned at least as far from photoconductor surface 22 as conductive grid 92 is positioned from photoconductor surface 22 (e.g., at least 1 mm). Preferably, air inlet 100 and air outlet 102 are positioned from photoconductor surface 22 by approximately the same distance as corona wire 90 is positioned from photoconductor surface 22 (e.g., in the range of 4 to 15 mm). In a preferred embodiment, airflow 98 moves in the same direction as the photoconductor surface 22, so as to reduce or minimize the creation of eddy currents at the air/oil boundary. In one embodiment, the volume of airflow 98, the size of air inlet 100 and the size of air outlet 102 are selected such that the speed of airflow 98 between inlet 100 and outlet 102 approximates the speed of photoconductor surface 22 past the charging apparatus 30. That is, the relative difference between the speed of airflow 98 and the speed of photoconductor surface 22 is preferably minimized. In this manner, evaporative thinning of the submicron oil layer on the photoconductor surface 22 is reduced or eliminated. In addition, because ozone is not actively moved toward the photoconductor surface 22, the chemical exposure of the oil layer on the photoconductor surface 22 is reduced or eliminated. The reduction or elimination of evaporative thinning and chemical exposure of the oil layer on the photoconductor surface 22 reduces the amount and rate of polymerization of residual material in the oil layer, and thereby reduces filming of the photoconductor surface 22.

In FIG. 3, air inlet 100 and air outlet 102 of chamber 96 are illustrated as being connected to plenums 110, 112, respectively, that are integrated into the housing 80. In turn, plenums 110, 112 are in fluid communication with the fresh air source and vacuum system 72, respectively. However, the plenums 110, 112, of the airflow control system do not need to be integrated into the housing 80, and may be eliminated in alternate embodiments. For example, inlet 100 and outlet 102 may be directly connected to the fresh air supply and vacuum system 72 without the use of plenums 110, 112.

Figure 4B:
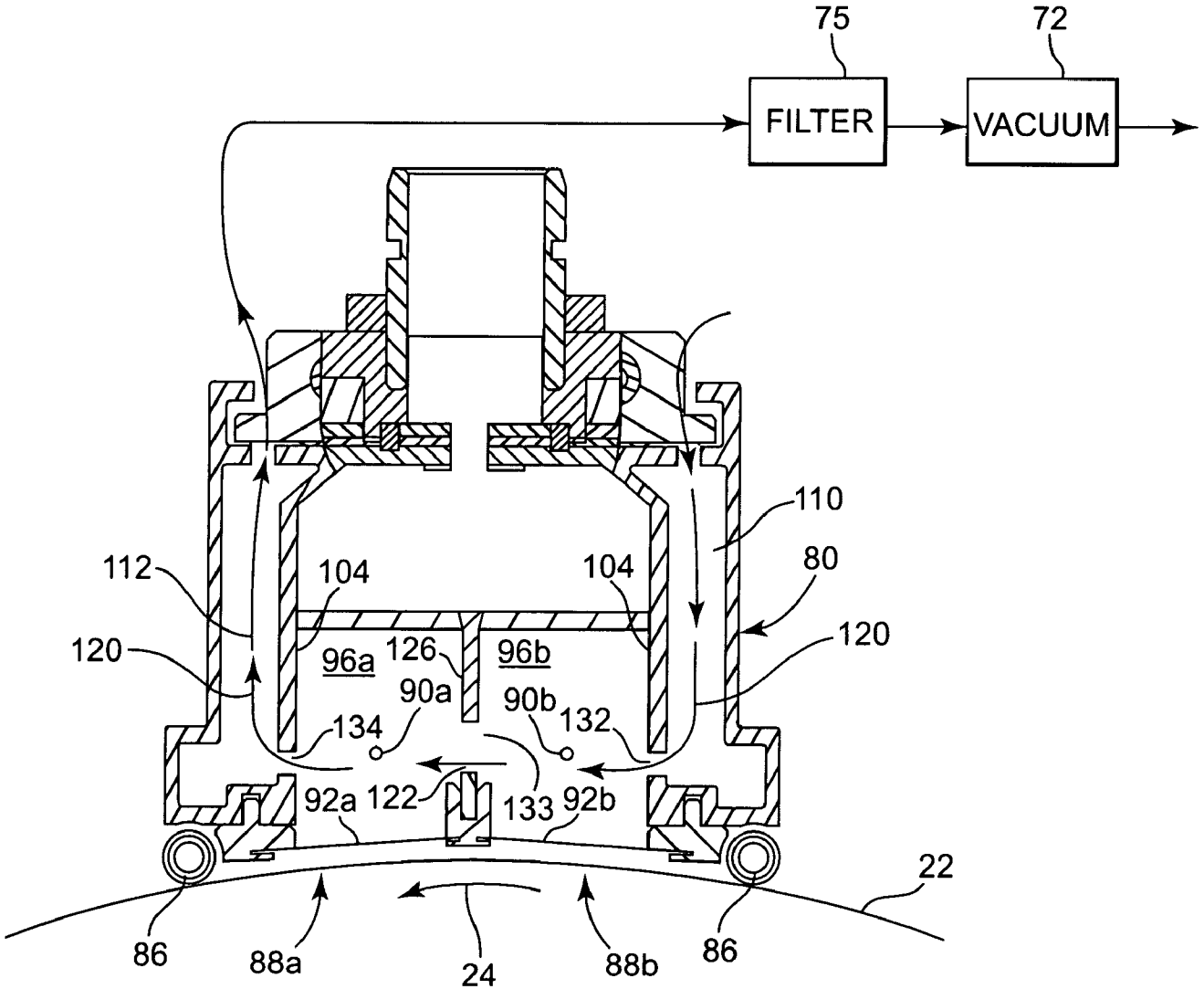
FIG. 4B is a schematic illustration of an alternate airflow control system in the charging apparatus of FIG. 4A.

In other embodiments according to the invention, more than one charging device 88 is provided in the housing 80, with the airflow control system providing each charging device 88 with its own ventilating airflow. In FIGS. 4A and 4B, the illustrated charging apparatus 30 includes two discrete charging devices 88*a* and 88*b* each positioned adjacent first end 82 of housing 80, such that the charging devices 88*a*, 88*b* are arranged adjacent the photoconductor surface 22. Photoconductor surface 22 moves in the direction generally indicated by arrow 24. As discussed with respect to the embodiment of FIG. 3, first end 82 of housing 80 is configured for positioning adjacent photoconductor surface 22 without contacting surface 22. Each charging device 88*a*, 88*b* is characterized by a corona producing wire 90*a*, 90*b*, respectively, and an associated electrically conductive screen or grid 92*a*, 92*b* disposed between the associated corona wire 90*a*, 90*b* and the surface 22 to be charged. The charging devices 88*a*, 88*b* operate as discrete charging devices within a single housing 80, and are positioned within different chambers 96*a*, 96*b*, respectively, of the housing 80. In other embodiments according to the invention, additional charging devices 88 may be provided in the housing 80. As described above with respect to the embodiment of FIG. 3, the corona producing wires 90*a*, 90*b* are positioned in the range of 4 to 15 mm from photoconductor surface 22, while conductive grids 92*a*, 92*b* are positioned approximately 1 mm or less from the photoconductor surface 22.

In the charging apparatus of FIG. 4A, the airflow control system establishes an active ventilating airflow through each chamber 96*a*, 96*b* that protects the oil layer on the photoconductor surface 22 from evaporative thinning. As seen in FIG. 4A, the airflow control system directs air through chambers 96*a*, 96*b* in the direction of arrows 120 by a suitable vacuum system 72 providing a volume airflow in the range of 0.1 to 30 liters/second, depending upon the ventilation requirements of the particular imaging application. An air inlet 122 and air outlet 124 are provided in opposite side walls 104 of each of the chambers 96*a*, 96*b*, respectively, such that air flows through chambers 96*a*, 96*b* from the air inlet 122 to the air outlet 124 in a direction substantially parallel to and spaced apart from the photoconductor surface 22 and the conductive grids 92*a*, 92*b*, and then on to a filter system 75 without being directed toward or against the photoconductor surface 22. In the embodiment illustrated in FIG. 4A, a common air inlet 122 is provided from the common wall 126 dividing chambers 96*a*, 96*b*, and separate air outlets 124 are provided for each chamber 96*a*, 96*b*. In an alternate embodiment, the airflow direction can be reversed from that illustrated in FIG. 4A, such that common air inlet 122 becomes an air outlet, and the air outlets 124 become air inlets. In yet another alternate embodiment, separate air inlets and outlets can be provided for each chamber.

The air inlet 122 and air outlets 124 are preferably positioned in the sidewalls 104 of chambers 96*a*, 96*b* such that the airflow is directed substantially parallel to and spaced apart from the photoconductor surface 22, over corona wires 90*a*, 90*b*, and further such that airflow between the photoconductor surface 22 and the conductive grids 92*a*, 92*b* is restricted or eliminated. Air inlet 122 and air outlets 124 are positioned at least as far from photoconductor surface 22 as conductive grids 92*a*, 92*b* are positioned from photoconductor surface 22 (e.g., at least 1 mm). Preferably, air inlet 122 and air outlets 124 are positioned from photoconductor surface 22 by approximately the same distance as corona wires 90*a*, 90*b* are positioned from photoconductor surface 22 (e.g., in the range of 4 to 15 mm). In this manner, evaporative thinning of the submicron oil layer on the photoconductor surface 22 is reduced or eliminated. In addition, because ozone is not actively moved toward the photoconductor surface 22, the chemical exposure of the oil layer on the photoconductor surface 22 is reduced or eliminated. The reduction or elimination of evaporative thinning and chemical exposure of the oil layer on the photoconductor surface 22 reduces the amount and rate of polymerization of residual material in the oil layer, and thereby reduces filming of the photoconductor surface 22. FIG. 4B illustrates a variation of the airflow control system in the charging apparatus of FIG. 4A.

In FIG. 4B, the airflow control system directs air through chambers 96*a*, 96*b* in the direction of arrow 120, such that air flows through chambers 96*a*, 96*b* from the air inlet 132, through opening 133 in common wall 126 to the air outlet 134 in a direction substantially parallel to, spaced apart from, and in the same direction as the photoconductor surface 22, and then on to filter system 75 without being directed toward or against the photoconductor surface 22. Air inlet 132 and air outlet 134 are positioned at least as far from photoconductor surface 22 as conductive grids 92*a*, 92*b* are positioned from photoconductor surface 22 (e.g., at least 1 mm). Preferably, air inlet 132 and air outlet 134 are positioned from photoconductor surface 22 by approximately the same distance as corona wires 90*a*, 90*b* are positioned from photoconductor surface 22 (e.g., in the range of 4 to 15 mm). In a preferred embodiment, vacuum system 72 creates volume airflow in the range of 0.1 to 30 liters/second, depending upon the ventilation requirements of the particular imaging application. Preferably, the volume of the airflow, the size of air inlet 132, opening 133 and air outlet 134 are selected such that the speed of the airflow between inlet 132 and outlet 134 approximates the speed of photoconductor surface 22. That is, the relative difference between the speed of the air and the speed of photoconductor surface 22 is preferably minimized.

EXAMPLE

Figure 2A:
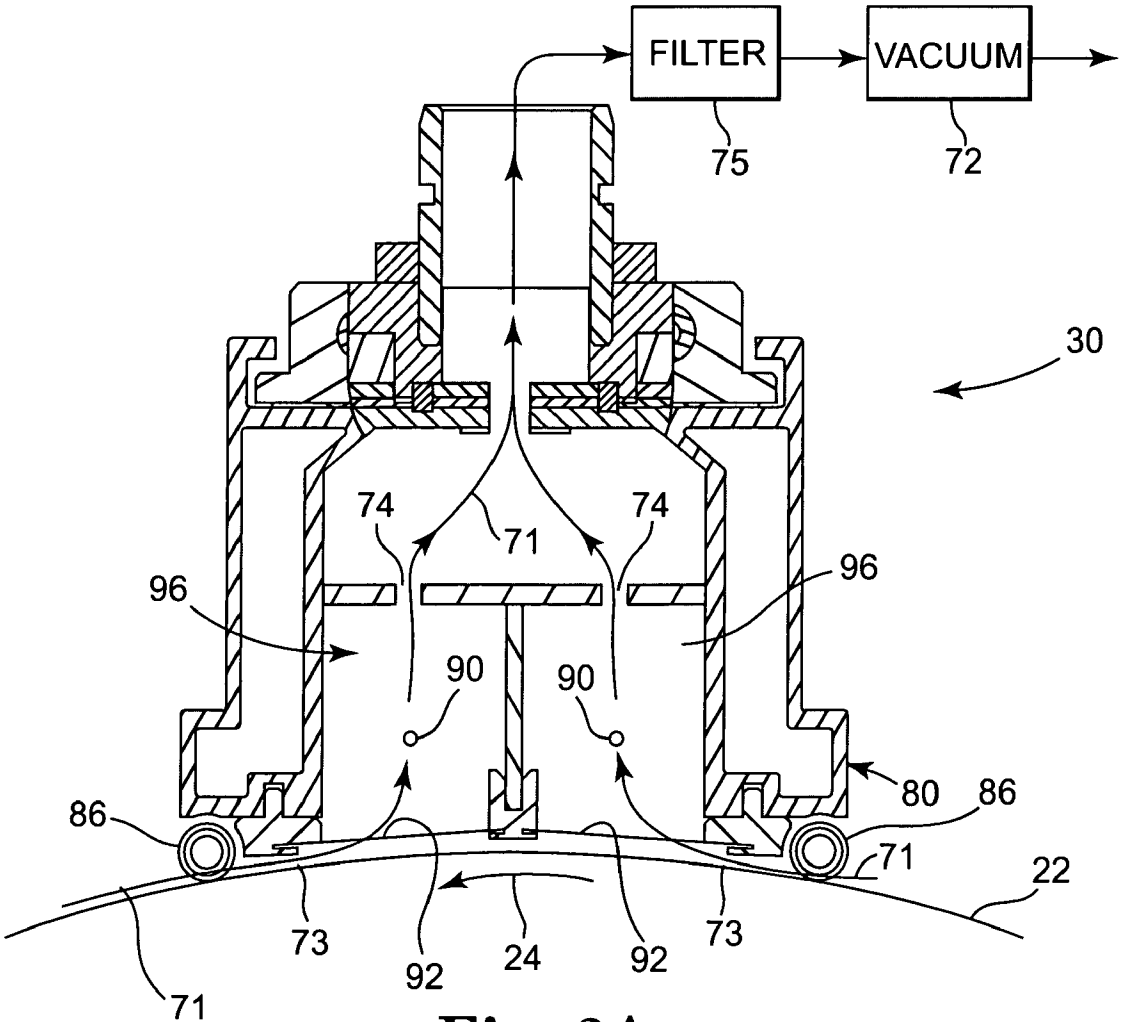
Fig. 2A PRIOR ART
FIGS. 2A–2B are schematic cross-sectional views of embodiments of prior art charging apparatuses.
Figure 2B:
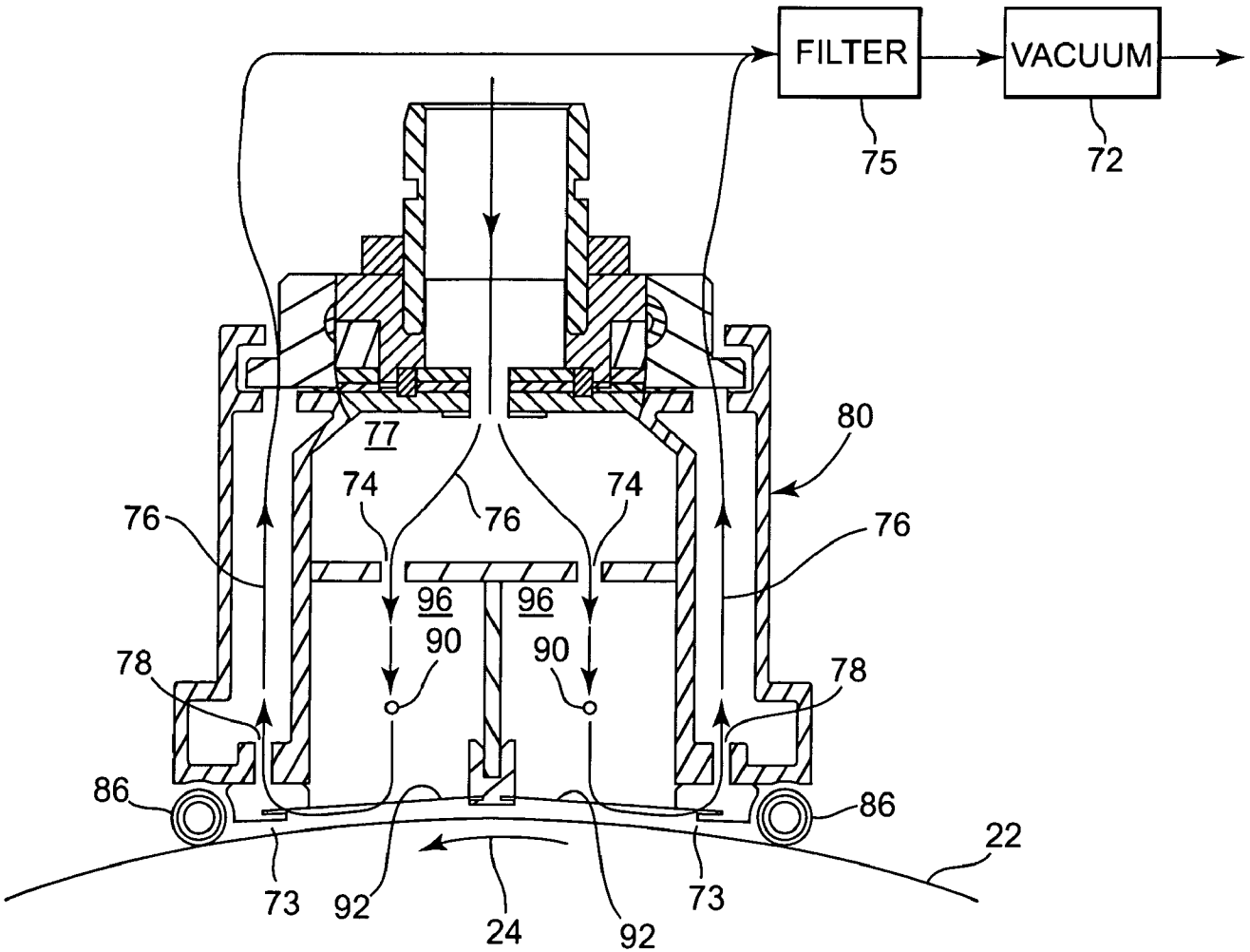
Fig. 2B PRIOR ART
Figure 5:
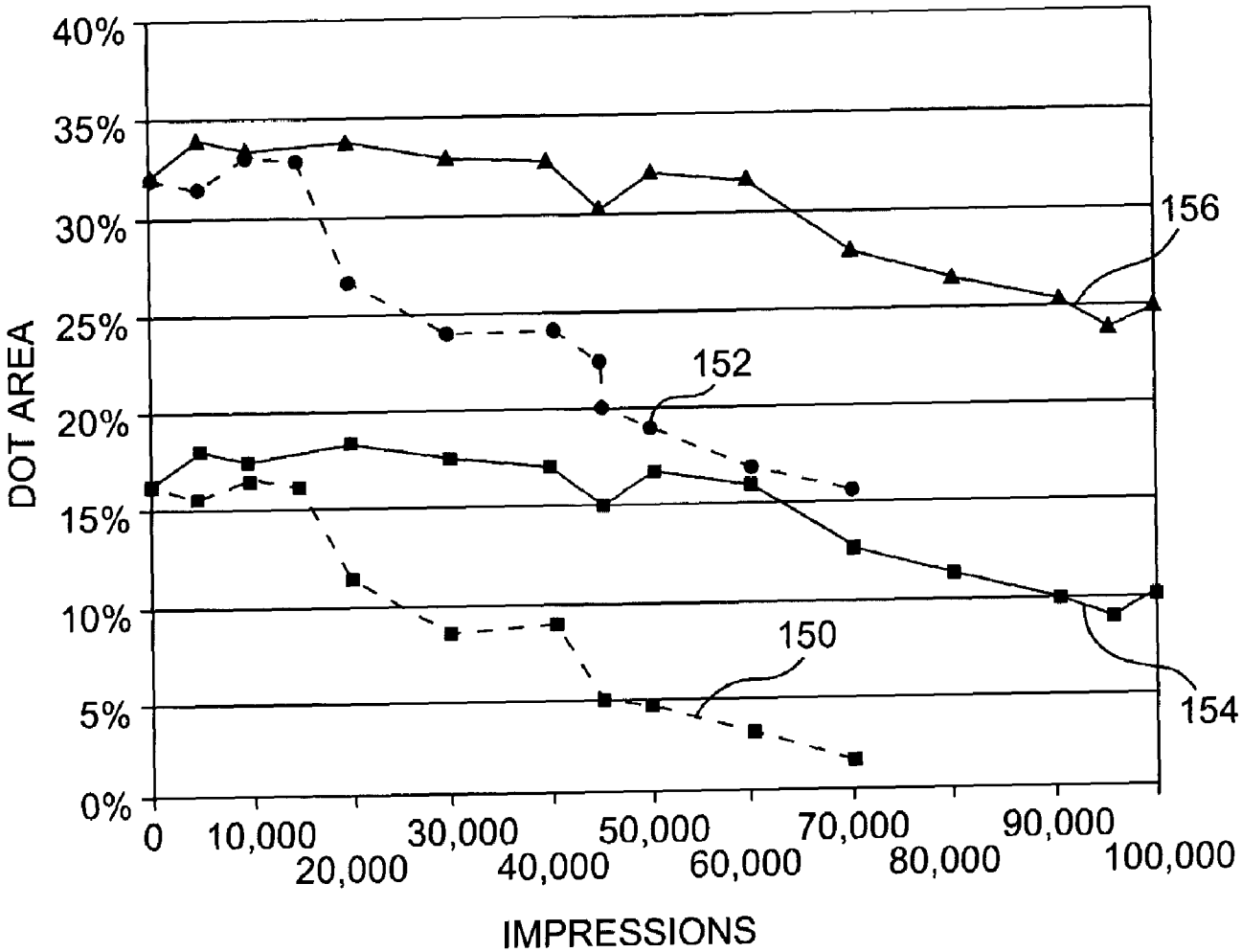
FIG. 5 is an exemplary graph illustrating the improved photoconductor aging achieved using the charging apparatus with an airflow control system of FIG. 3.

A liquid electrophotographic (LEP) printer was operated with a charging apparatus having an airflow control system like that illustrated in FIG. 2A for 100,000 printing cycles at 10% and 20% grayscale, and the dot area was measured at periodic intervals. Dot area is the estimated ink coverage of a tint patch, and is typically derived using an optical densitometer. The LEP printer was also operated for 100,000 printing cycles at 10% and 20% grayscale with a charging apparatus 30 having an improved airflow pattern like that illustrated in FIG. 3, and the dot area was measured at periodic intervals. The change in dot area for the prior art airflow pattern of FIG. 2A and the improved airflow pattern of FIG. 3 is illustrated in the graph of FIG. 5, where lines 150 and 152 indicate the prior art airflow pattern at 10% and 20% grayscale, respectively, and lines 154 and 156 indicate the improved airflow pattern at 10% and 20% grayscale, respectively. A decrease in dot area is indicative of filming of the photoconductor surface. Examining FIG. 5, it can be seen that the improved airflow pattern results in a much slower decrease in dot area for both 10% and 20% grayscale when compared to the prior art airflow pattern. The dip occurring in each of lines 150, 152, 154, 156 at approximately 45,000 printing cycles coincides with replacement of the intermediate transfer roller 62.

As described herein, the liquid electrophotograpic printer with the charging apparatus 30 having an airflow control system with improved airflow according to the present invention reduces the amount and rate of accumulation of residual materials and contaminants on the photoconductor surface 22 during operation of the LEP printer. Thus, the rate of deterioration of print quality is decreased and the life span of the photoconductor surface 22 is increased.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An apparatus for reducing contamination of an image transfer surface in an image transfer device, comprising:

at least one charging device for charging the image transfer surface, wherein each charging device comprises at least one corona wire positioned above the image transfer surface; and an airflow control system configured to ventilate the charging device and direct airflow across the at least one corona wire in substantially the same direction as the image transfer surface, and substantially parallel to and spaced apart from the image transfer surface.

2. The apparatus of claim 1, wherein each charging device comprises:

a conducting grid positioned between the corona wire and the image transfer surface;

wherein the airflow control system is configured to restrict airflow between the conducting grid and the image transfer surface.

3. The apparatus of claim 2, wherein the conducting grid is spaced from the image transfer surface by a distance less than approximately 1 mm.

4. The apparatus of claim 1, wherein the airflow control system includes an air inlet and an air outlet spaced apart from the image transfer surface by a distance of at least 1 mm.

5. The apparatus of claim 4, wherein at least one of the air inlet and air outlet are positioned adjacent the corona wire.

6. The apparatus of claim 4, wherein at least one of the air inlet and air outlet are positioned in a side wall of the charging device.

7. The apparatus of claim 2, wherein the air inlet and air outlet are positioned to direct airflow past the conducting grid in a direction substantially parallel to the conducting grid.

8. The apparatus of claim 1, wherein the charging device is an ionization device selected from the group consisting of corotrons, dicorotrons, scorotrons, and discorotrons.

9. The apparatus of claim 1, wherein the airflow moves at substantially the same speed as the image transfer surface.

10. The apparatus of claim 1, wherein the airflow control system maintains a partial vapor pressure of imaging oil adjacent the image transfer surface.

11. A liquid electrophotographic (LEP) device comprising:

a photoconductor surface for creating an image thereon, the image formed by liquid including imaging oil;

a scorotron having a corona wire for charging the photoconductor surface to a predetermined electric potential; and a ventilation control apparatus including an air inlet and an air outlet in the scorotron, the air inlet and air outlet spaced apart from the photoconductor surface for directing airflow across the corona wire in the same direction as the photo conductor surface, and parallel to and spaced apart from the photoconductor surface.

12. The liquid electrophotographic device of claim 11, wherein the ventilation control apparatus comprises an ozone filtration system.

13. The liquid electrophotographic device of claim 11, wherein the ventilation control apparatus maintains a partial vapor pressure of the imaging oil adjacent the photoconductor surface.

14. The liquid electrophotographic device of claim 11, further comprising:

an exposure device for forming a latent image on the photoconductor surface;

a development device for developing the latent image on the photoconductor surface to obtain the image formed by liquid including imaging oil; and an image transfer apparatus for transferring the image from the photoconductor surface to a printing sheet.

15. The liquid electrophotographic device of claim 11, wherein the photoconductor surface is on a drum.

16. The liquid electrophotographic device of claim 11, wherein the photoconductor surface is on a continuous belt.

17. A scorotron for electrically charging an image transfer surface in an image transfer device, the scorotron comprising:

a housing having a first end configured for positioning adjacent an image transfer surface;

a first corona wire within the housing;

a first conducting grid positioned adjacent the first end of the housing such that the conducting grid is between the first corona wire and the first end of the housing;

an air inlet in the housing, the air inlet spaced away from the first end of the housing; and a first air outlet in the housing, the first air outlet spaced away from the first end of the housing;

wherein the air inlet and first air outlet repositioned in the housing such that air flows through the housing across the corona wire in substantially the same direction as the image transfer surface, and substantially parallel to and spaced apart from the image transfer surface.

18. The scorotron of claim 17, wherein the air inlet and first air outlet are positioned such that air flows across the first corona wire.

19. The scorotron of claim 17, further comprising:

a second corona wire within the housing; and a second conducting grid positioned adjacent the first end of the housing such that the second conducting grid is between the second corona wire and the first end of the housing;

wherein the first corona wire and first conducting grid are positioned in a first lateral half of the housing and the second corona wire and second conducting grid are positioned in a second lateral half of the housing.

20. The scorotron of claim 19, further comprising:

a second air outlet in the housing, the second air outlet spaced away from the first end of the housing, the air inlet and second air outlet positioned in the housing such that air flows through the housing in a direction substantially parallel to and spaced apart from the image transfer surface.

21. The scorotron of claim 20, wherein the air inlet is positioned between the first and second corona wires, the first air outlet is positioned in the first lateral half of the housing, and the second air outlet is positioned in the second lateral half of the housing.

22. The scorotron of claim 21, wherein air flowing across the first corona wire exits the housing through the first air outlet, and air flowing across the second corona wire exits the housing through the second air outlet.

23. A method of reducing the development of contaminating material on an image transfer surface in an image transfer device of the type using an imaging oil to form an image onto image transfer surface, the image transfer device having an ionization-type charging device having a corona generating wire for charging the image transfer surface to a predetermined electric potential, the method comprising:

applying imaging oil to at least a portion of the image transfer surface; and directing airflow across the corona generating wire in substantially the same direction as the image transfer surface, and substantially parallel to and spaced apart from the portion of the image transfer surface as the portion of the image transfer surface moves past the charging device.

24. The method of claim 23, wherein directing airflow in a direction substantially parallel to and spaced apart from the image transfer surface comprises integrating a ventilation system into the charging device, the ventilation system having an air inlet and an air outlet spaced away from the image transfer surface and configured to direct airflow substantially parallel to the image transfer surface.

25. The method of claim 24, wherein integrating a ventilation system into the charging device comprises positioning the air inlet and air outlet in the range of 4 to 15 mm from the image transfer surface.

26. The method of claim 24, wherein integrating a ventilation system into the charging device comprises positioning each of the corona generating wire of the charging device, the air inlet and the air outlet at approximately the same distance from the image transfer surface.

27. The method of claim 24, wherein controlling the movement of air over the image transfer surface comprises maintaining airflow in the range of 0.1 to 30 liters/seconds.

28. The method of claim 23, wherein the charging device includes a conducting grid spaced from the image transfer surface, and wherein directing airflow in a direction substantially parallel to and spaced apart from the image transfer surface includes restricting airflow between the conducting grid and the image transfer surface.

29. The method of claim 23, wherein directing airflow in a direction substantially parallel to and spaced apart from the image transfer surface maintains a partial vapor pressure of imaging oil adjacent the image transfer surface.

30. An apparatus for reducing contamination of an image transfer surface in an image transfer device, comprising:

at least one charging device including a corona generating wire for charging the image transfer surface; and means for directing airflow across the corona generating wire in substantially the same direction as the image transfer surface, and substantially parallel to and spaced apart from the image transfer surface.

* * * * *